US009926155B2

(12) United States Patent
Hoshi et al.

(10) Patent No.: US 9,926,155 B2
(45) Date of Patent: Mar. 27, 2018

(54) THERMAL PRINT APPARATUS AND METHOD OF CONTROLLING THE SAME

(71) Applicant: SATO HOLDINGS KABUSHIKI KAISHA, Tokyo (JP)

(72) Inventors: Kazuyuki Hoshi, Saitama (JP); Atsuo Kayama, Chiba (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/329,772

(22) PCT Filed: Jul. 30, 2015

(86) PCT No.: PCT/JP2015/071639
§ 371 (c)(1),
(2) Date: Jan. 27, 2017

(87) PCT Pub. No.: WO2016/021477
PCT Pub. Date: Feb. 11, 2016

(65) Prior Publication Data

US 2017/0217705 A1 Aug. 3, 2017

(30) Foreign Application Priority Data

Aug. 5, 2014 (JP) ..... 2014-159326

(51) Int. Cl.
*B65H 7/06* (2006.01)
*B41J 11/42* (2006.01)
(Continued)

(52) U.S. Cl.
CPC ..... *B65H 7/06* (2013.01); *B41J 11/42* (2013.01); *B41J 2/32* (2013.01); *B41J 2/325* (2013.01); *B41J 25/312* (2013.01)

(58) Field of Classification Search
CPC ... B41J 11/04; B41J 11/02; B41J 11/42; B41J 2/325; B41J 2/32; B41J 25/312; B65H 2511/528; B65H 7/06
See application file for complete search history.

(56) References Cited

U.S. PATENT DOCUMENTS 5,052,835 A * 10/1991 Takahashi ..... B41J 29/50 358/1.18
5,779,370 A 7/1998 Schroeder et al.
(Continued)

FOREIGN PATENT DOCUMENTS

JP 4-288259 A 10/1992
JP 6-1493 A 1/1994
(Continued)

*Primary Examiner* — David Bahn
(74) *Attorney, Agent, or Firm* — Foley & Lardner LLP

(57) ABSTRACT

Disclosed is a thermal print apparatus including a medium detection sensor arranged from a thermal head at a distance shorter than an outer circumferential length of the platen roller, and a controller. The controller determines that the print medium is wrapped around the platen roller if the print medium is not detected by the medium detection sensor even when the print medium is fed by a feed amount at which the leading edge of the print medium reaches the medium detection sensor after starting of printing on the print medium. In this case, the print medium is fed backward by reversely rotating the platen roller.

8 Claims, 6 Drawing Sheets

(51) Int. Cl.

| | |
|---|---|
| *B41J 2/325* | (2006.01) |
| *B41J 2/32* | (2006.01) |
| *B41J 25/312* | (2006.01) |

(56) References Cited

U.S. PATENT DOCUMENTS

| | | | | |
|---|---|---|---|---|
| 5,993,093 | A * | 11/1999 | Schoennauer | B26D 1/385 400/613 |
| 6,210,053 | B1 | 4/2001 | Suzuki et al. | |
| 2002/0057300 | A1* | 5/2002 | Baker | B65B 51/067 347/2 |
| 2003/0189631 | A1* | 10/2003 | Hoshino | B41J 2/32 347/218 |
| 2005/0162501 | A1* | 7/2005 | Seo | B26D 1/045 347/157 |
| 2008/0122917 | A1 | 5/2008 | Higuchi | |
| 2013/0138391 | A1* | 5/2013 | Jackson | B65H 7/00 702/150 |

FOREIGN PATENT DOCUMENTS

| | | | |
|---|---|---|---|
| JP | 3041472 | B2 | 5/2000 |
| JP | 3563986 | B2 | 9/2004 |
| JP | 3636476 | B2 | 4/2005 |
| JP | 2007-196454 | A | 8/2007 |
| JP | 4029250 | B2 | 1/2008 |
| JP | 2009-179466 | A | 8/2009 |
| JP | 2010-082915 | A | 4/2010 |
| JP | 2012-187822 | A | 10/2012 |

* cited by examiner

THERMAL PRINT APPARATUS AND METHOD OF CONTROLLING THE SAME

TECHNICAL FIELD

The present invention relates to a thermal print apparatus for printing characters or figures on a print medium such as a roll label, a roll tag, and a band, and more particularly, to a technology for recovering a normal operation state from a medium jam.

BACKGROUND ART

In a thermal print apparatus, one cause of a medium jam is that the print medium is wrapped around a platen roller.

If a print medium is curved or warped while the print medium is wound in a roll shape or while the print medium is sandwiched between a thermal head and the platen roller, the print medium subjected to printing adheres to the platen roller and is easily wrapped around the platen roller. Such wrapping-around of the print medium more easily occurs in the case of a linerless label having an adhesive surface on one side.

In a thermal print apparatus discussed in JP 3636476 B, a stripper is arranged at a downstream side from the platen roller and the thermal head in order to suppress wrapping of the print medium around the platen roller. In this configuration, a print medium passing through a gap between the thermal head and the platen roller is guided to the stripper and is forcibly removed from the platen roller using the stripper. Therefore, wrapping the print medium around the platen roller may be effectively suppressed.

SUMMARY OF INVENTION

However, in this technique of the prior art, it is difficult to perfectly prevent that a print medium is wrapped around the platen roller. For example, when a print medium strongly adheres to the platen roller, and the print medium subjected to printing does not reach the stripper, there is still a possibility of wrapping-around of a print medium. In this regard, it is desirable to provide a method of easily recovering a normal operation state even when wrapping-around of a print medium occurs.

In many cases, when wrapping-around of a print medium to platen roller is occurred, a user stretches fingers to the vicinity of the platen roller to remove the wrapped print medium. However, since various components such as a head unit, a platen roller driving motor, and various sensors are installed in the vicinity of the platen roller, workability is poor. In this case, it is desirable to provide a method of easily removing the print medium wrapped around the platen roller.

In view of the aforementioned problems, it is therefore an object of the present invention to provide a method of facilitating a normal operation recovery work when a print medium is wrapped around the platen roller.

According to an aspect of the present invention, there is provided a thermal print apparatus including: a thermal head configured to perform printing on a print medium; a platen roller configured to feed the print medium by sandwiching the print medium between the thermal head and the platen roller; a medium detection sensor arranged from the thermal head at a distance shorter than an outer circumferential length of the platen roller; a wrapping-around determination means configured to determine that the print medium is wrapped around the platen roller if the print medium is not detected by the medium detection sensor even when the print medium is fed by a feed amount at which a leading edge of the print medium reaches the medium detection sensor after starting of printing on the print medium; and a recovery processing means configured to feed the print medium backward by reversely rotating the platen roller when the wrapping-around determination means determines that the print medium is wrapped around the platen roller.

According to this aspect, wrapping-around of a print medium is determined before the print medium is wound around the entire platen roller, and the print medium is fed back by reversely rotating the platen roller. Therefore, it is possible to smoothly strip or remove the print medium wrapped around the platen roller from the platen roller. As a result, it is not necessary to perform a work for removing the print medium wrapped around the platen roller by stretching user's fingers to the vicinity of the platen roller in most cases. Therefore, it is possible to facilitate a normal operation recovery work.

DESCRIPTION OF EMBODIMENTS

Embodiments of the present invention will now be described with reference to the accompanying drawings.

Figure 1:
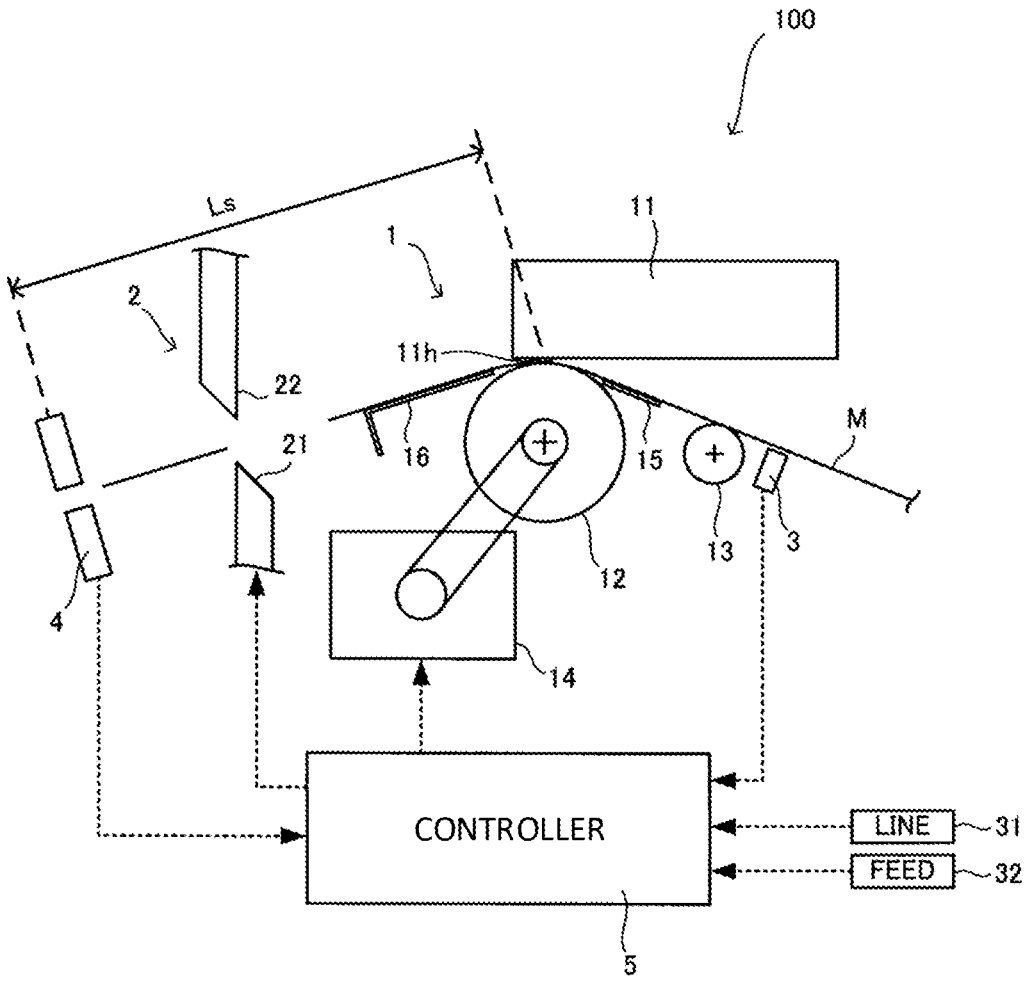
FIG. 1 is a schematic diagram illustrating a thermal print apparatus according to an embodiment of the invention.

FIG. 1 is a schematic diagram illustrating a thermal print apparatus 100 according to an embodiment of the invention. The thermal print apparatus 100 is an apparatus that performs thermal printing on a print medium M such as a roll label, a roll tag, and a band and may be operated in any printing such as a heat-sensitive printing in which a heat-sensitive medium is heated for printing, or a heat transfer printing in which an ink ribbon is heated, and ink on the ink ribbon is transferred onto a medium for printing. The thermal print apparatus 100 is integrated into a printer such as a label printer in many cases. Alternatively, the thermal print apparatus 100 may also be integrated into other systems.

A configuration of the thermal print apparatus 100 will be described. The thermal print apparatus 100 includes a print mechanism 1, a cutter 2, a medium position sensor 3, a medium detection sensor 4, and a controller 5.

The print mechanism 1 includes a head unit 11, a platen roller 12, a guide roller 13, a platen roller driving motor 14, an upstream-side guide 15, and a downstream-side guide 16. The print mechanism 1 is a mechanism that performs printing on a print medium M and feeding of the print medium M. The platen roller driving motor 14 is a step motor in this example and drives the platen roller 12 with a belt, a gear, and the like. Note that, in the following description, an operation for conveying the print medium M to a downstream side will be simply referred to as "feeding," and an operation for conveying the print medium M to an upstream side will be referred to as "back-feeding."

The head unit 11 holds a thermal head 11*h* while a heating element of a thermal head 11*h* is exposed on its lower face. The platen roller 12 is disposed immediately under the thermal head 11*h*. The head unit 11 is supported for free swinging by the casing of the thermal print apparatus 100 by using as an intermediary a hinge mechanism or the like. The head unit 11 can be displaced between an open position in which the thermal head 11*h* is arranged from the platen roller 12 and a close position in which the thermal head 11*h* is pressed to the platen roller 12.

As the guide roller 13 and the upstream-side guide 15 guides the print medium M to a gap between the thermal head 11*h* and the platen roller 12, the print medium M is sandwiched between the thermal head 11*h* and the platen roller 12. In the case of heat transfer printing, an ink ribbon as well as the print medium M are sandwiched between the thermal head 11*h* and the platen roller 12.

In this state, if the heating element of the thermal head 11*h* is electrically conducted, a color is developed on the print medium M by virtue of the heat of the heating element, or the ink of the ink ribbon is transferred onto the print medium M, so that printing is performed on the print medium M. In addition, if the platen roller 12 is rotated forward by the platen roller driving motor 14, the print medium M is guided by the downstream-side guide 16 and is fed to the downstream side.

The upstream-side guide 15 and the downstream-side guide 16 are plate-shaped members extending in an axial direction of the platen roller 12. The upstream-side guide 15 is placed between the platen roller 12 and the print medium M in the upstream side of the platen roller 12, and the downstream-side guide 16 is placed between the platen roller 12 and the print medium M in the downstream side of the platen roller 12, so that the upstream-side guide 15 and the downstream-side guide 16 make contact with the lower face of the print medium M to guide the print medium M.

Figure 2:
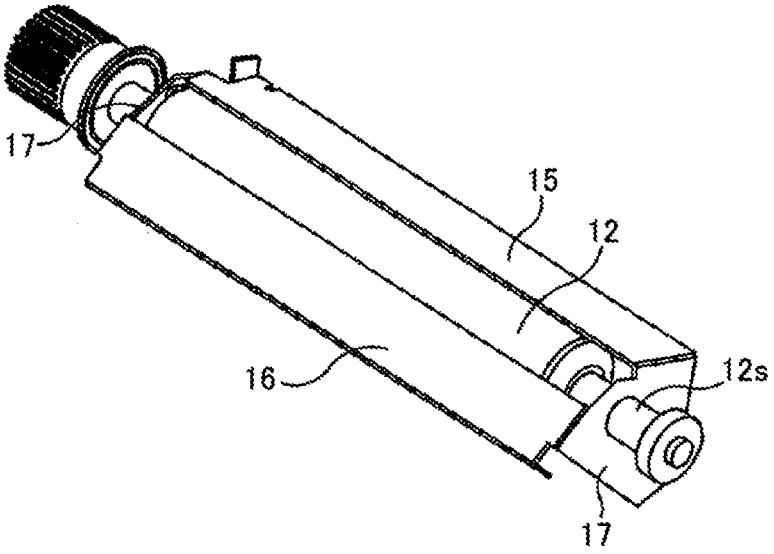
FIG. 2 is a perspective view illustrating an upstream-side guide, a downstream-side guide, and a platen roller.

As illustrated in FIG. 2, the upstream-side guide 15 and downstream-side guide 16 are connected to a bracket 17 in their longitudinal ends, so that the upstream-side guide 15, the downstream-side guide 16, and the bracket 17 are supported by the platen roller 12 as a shaft 12*s* of the platen roller 12 is inserted into the bracket 17. The bracket 17 is installed with a rotation fixing member (not shown) to restrict rotation of the upstream-side guide 15 and the downstream-side guide 16 with respect to the platen roller 12.

Note that, although both the upstream-side guide 15 and the downstream-side guide 16 are plate-shaped members in this embodiment, any other shape such as a bar-shaped guide, a roller guide, and a plurality of guide segments divided in the longitudinal direction may also be employed as long as the print medium M can be guided.

Returning to FIG. 1, the cutter 2 includes a movable blade 21 and a fixed blade 22. If the movable blade 21 is lifted by an actuator (not shown), the print medium M is sandwiched between a tip of the movable blade 21 and a tip of the fixed blade 22, so that the print medium M is cut in a predetermined length.

The medium position sensor 3 is a reflective photoelectric sensor capable of detecting a position detection alignment mark printed in advance on a rear surface of the print medium M. The medium position sensor 3 is used to detect a relative position of the print medium M with respect to the thermal head 11*h* and the cutter 2.

The medium detection sensor 4 is a transmission type photoelectric sensor capable of detecting presence of the print medium M. The medium detection sensor 4 is used to detect whether or not the print medium M is fed to a position of the medium detection sensor 4 without being wrapped around the platen roller 12. A distance Ls between the medium detection sensor 4 and the thermal head 11*h* is set to be shorter than an outer circumferential length Lp of the platen roller 12 (="diameter of the platen roller (12)"×π). This allows the controller to determine that the print medium M is wrapped-around and stop or reversely rotate the platen roller 12 before the print medium M is wound around the entire circumference of the platen roller 12 even when the print medium M is wrapped around the platen roller 12. This will be described below in more detail.

The controller 5 includes a microprocessor, a memory device such as a read-only memory (ROM) or a random access memory (RAM), an input/output (I/O) interface, a bus for connecting these components, and the like. The controller 5 receives, through the I/O interface, print data from an external computer (not shown), detection results from the medium position sensor 3 and the medium detection sensor 4, a pressing state of a LINE key 31 and a FEED key 32, and the like. The LINE key 31 is a key for switching a state of the thermal print apparatus 100 between an on-line state and an off-line state. The FEED key 32 is a key for feeding a predetermined amount of the print medium M by rotating the platen roller 12 forward if it is pressed while the thermal print apparatus 100 does not suffer from a medium jam error described below. The controller 5 executes a print control program stored in the memory device using the microprocessor to control whether or not electricity is supplied to the heating element of the thermal head 11*h*, the platen roller driving motor 14, the actuator of the cutter 2, or the like.

Figure 3:
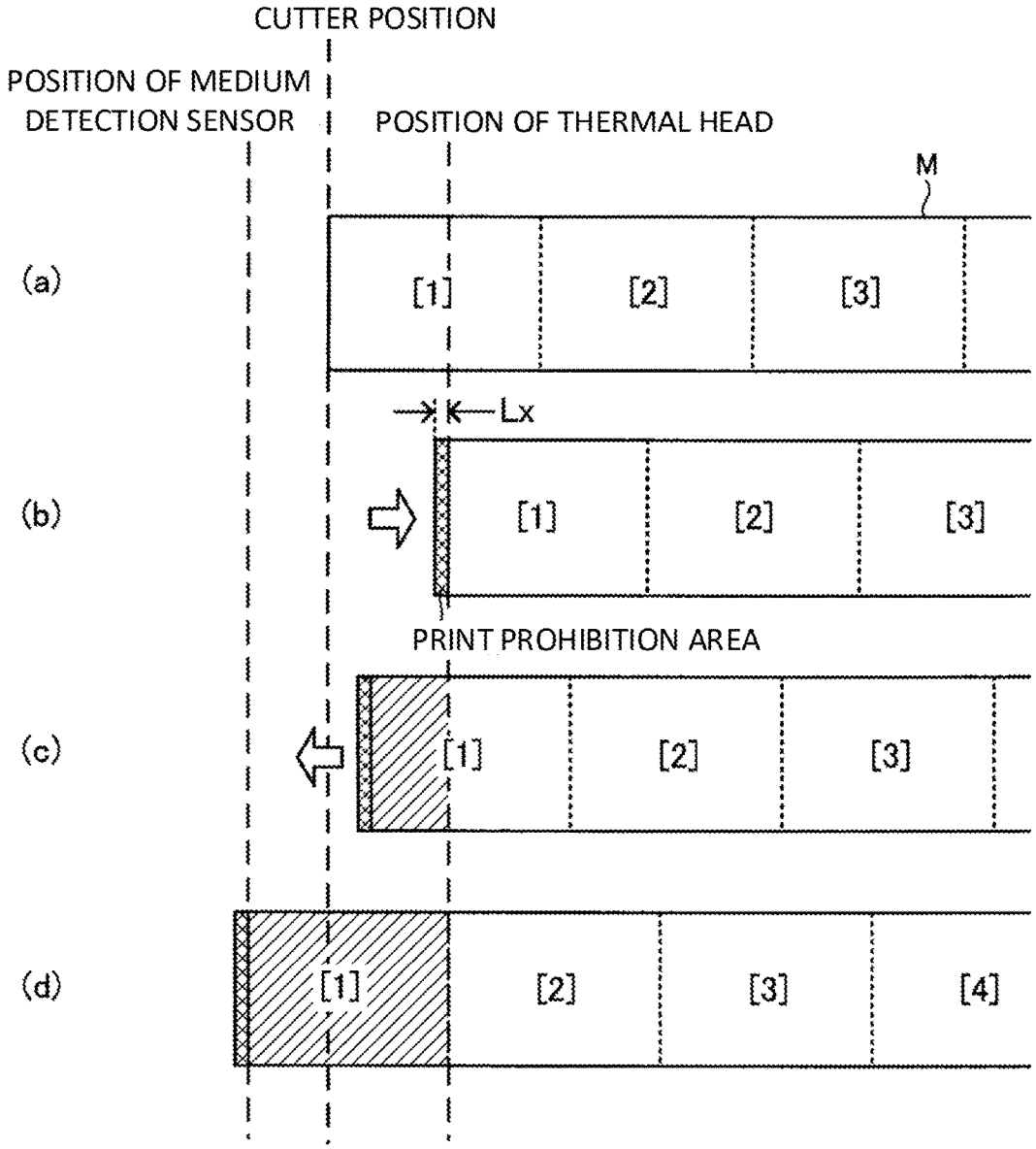
FIG. 3 is a diagram for describing a normal operation.

FIG. 3 illustrates a normal operation of the thermal print apparatus 100. The area [1] refers to a print area at the present time and corresponds to a single sheet. The areas [2] to [4] refer to print areas to be printed subsequently to the area [1] and correspond to sheets to be printed at the subsequent times (this similarly applies to FIG. 4).

In an initial state for printing on the print medium M, the previous sheet is cut by the cutter 2 (state (a)). Therefore, first, the controller 5 feeds the print medium M backward by reversely rotating the platen roller 12 and sets the print medium M in a print start position in which a print prohibition area provided in a leading edge of the print medium M protrudes to the downstream side from the thermal head 11*h* (state (a)→state (b)).

Then, the controller 5 allows the electric current to flow to the heating element of the thermal head 11*h* depending on a text or figure to be printed to print out a single line. In addition, the platen roller 12 is rotated forward by driving the platen roller driving motor 14 to feed the print medium M to the downstream side by a single line. The controller 5 repeats this operation a predetermined number of times until the feed amount of the state (b) reaches a predetermined feed amount (state(c)→state (d)).

The predetermined feed amount is obtained by subtracting a length Lx of the print prohibition area from the distance Ls between the medium detection sensor 4 and the heating element of the thermal head 11*h*. In a practical control, the predetermined feed amount is set by adding a total sum a for miscellaneous adjustment such as a print position adjustment length and a margin for preventing erroneous detection to this value.

The controller 5 determines whether or not the medium detection sensor 4 detects the print medium M. If it is determined that the medium detection sensor 4 detects the print medium M, the controller 5 determines that there is no wrapping-around of the print medium M. In addition, the controller 5 continuously performs printing on the print medium M as necessary.

Figure 4:
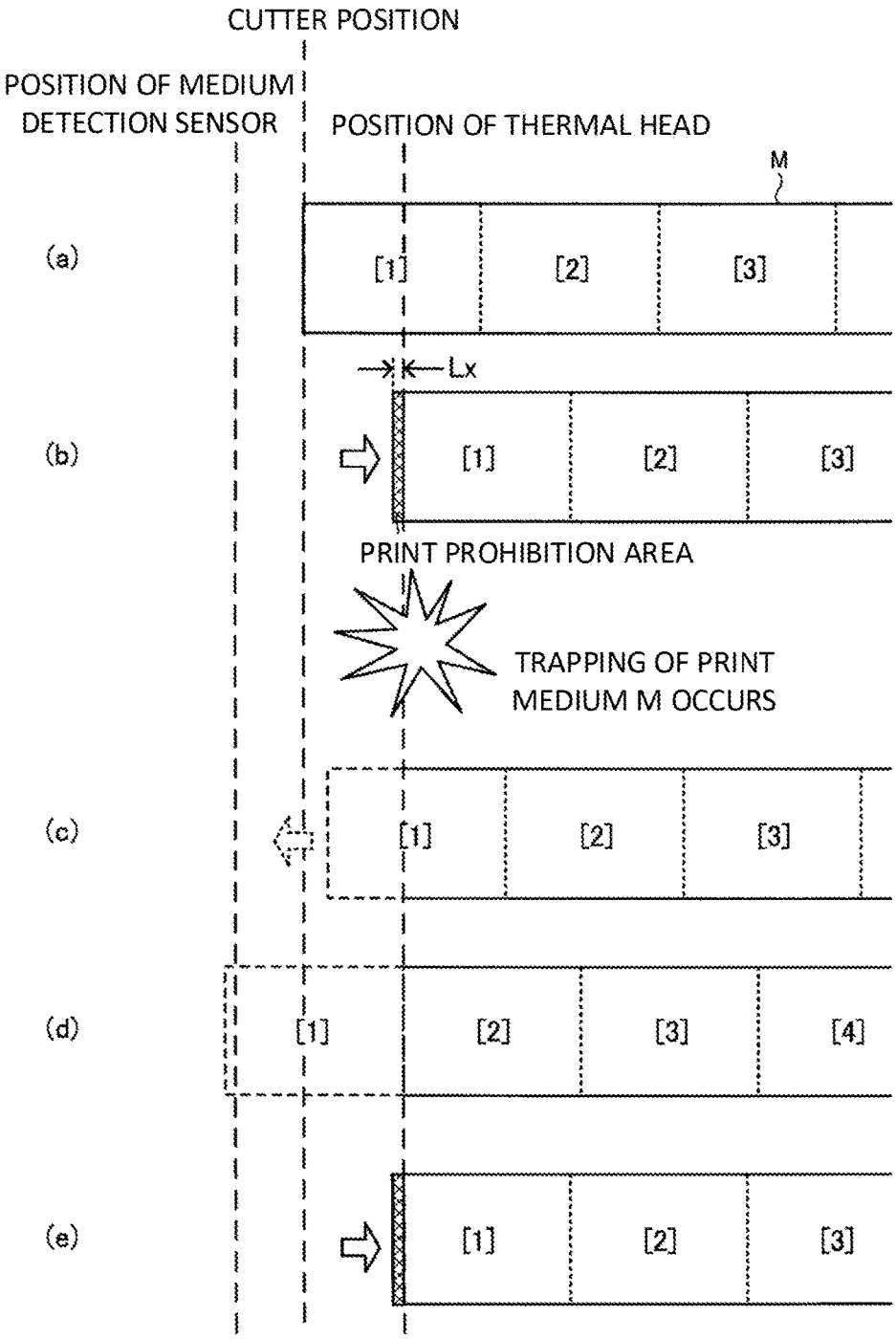
FIG. 4 is a diagram illustrating an operation when a medium jam occurs.

Meanwhile, FIG. 4 illustrates an operation of the thermal print apparatus 100 when a medium jam occurs. The states (a) to (d) of FIG. 4 correspond to the states (a) to (d) of FIG. 3, respectively.

If the print medium M is wrapped around the platen roller 12 from the state (b) to the state (d), the print medium M is not detected by the medium detection sensor 4 even when the feed amount of the print medium M from the state (b) reaches a predetermined feed amount.

Therefore, the controller 5 can determine that the print medium M is wrapped around the platen roller on the basis of a fact that the print medium M is not detected by the medium detection sensor 4. In addition, since the distance Ls between the thermal head 11*h* and the medium detection sensor 4 is shorter than the outer circumferential length Lp of the platen roller 12, it is possible to determine that the print medium M is wrapped around the platen roller 12 before the print medium M is wound around the entire circumference of the platen roller 12.

If it is determined that the print medium M is wrapped around the platen roller, the controller 5 immediately stops the platen roller 12 and reversely rotate the platen roller 12 to feed the print medium M backward by the feed amount of the print medium M from the state (b) to the state (d) (state (e)).

If the print medium M is wrapped around the entire circumference of the platen roller 12, a leading edge of the wound print medium M may intrude into a lower side of the next print target sheet. In particular, if the print medium M is a linerless label, a leading edge of the print medium M may adhere to a rear surface of the next print target sheet. In this case, a subsequent recovery work becomes cumbersome. However, according to this embodiment, it is determined that the print medium M is wrapped around the platen roller before the print medium M is wrapped around the entire circumference of the platen roller 12, and the print medium M is fed backward by reversely rotating the platen roller 12. Therefore, it is possible smoothly strip or remove the trapped print medium M from the platen roller 12 and facilitate a subsequent recovery work.

Since the upstream-side guide 15 is placed between the platen roller 12 and the print medium M, the upstream-side guide 15 serves as a stripper for stripping the print medium M from the platen roller 12 when the platen roller 12 is reversely rotated. As a result, it is possible to expedite stripping of the print medium M from the platen roller 12.

Figure 5:
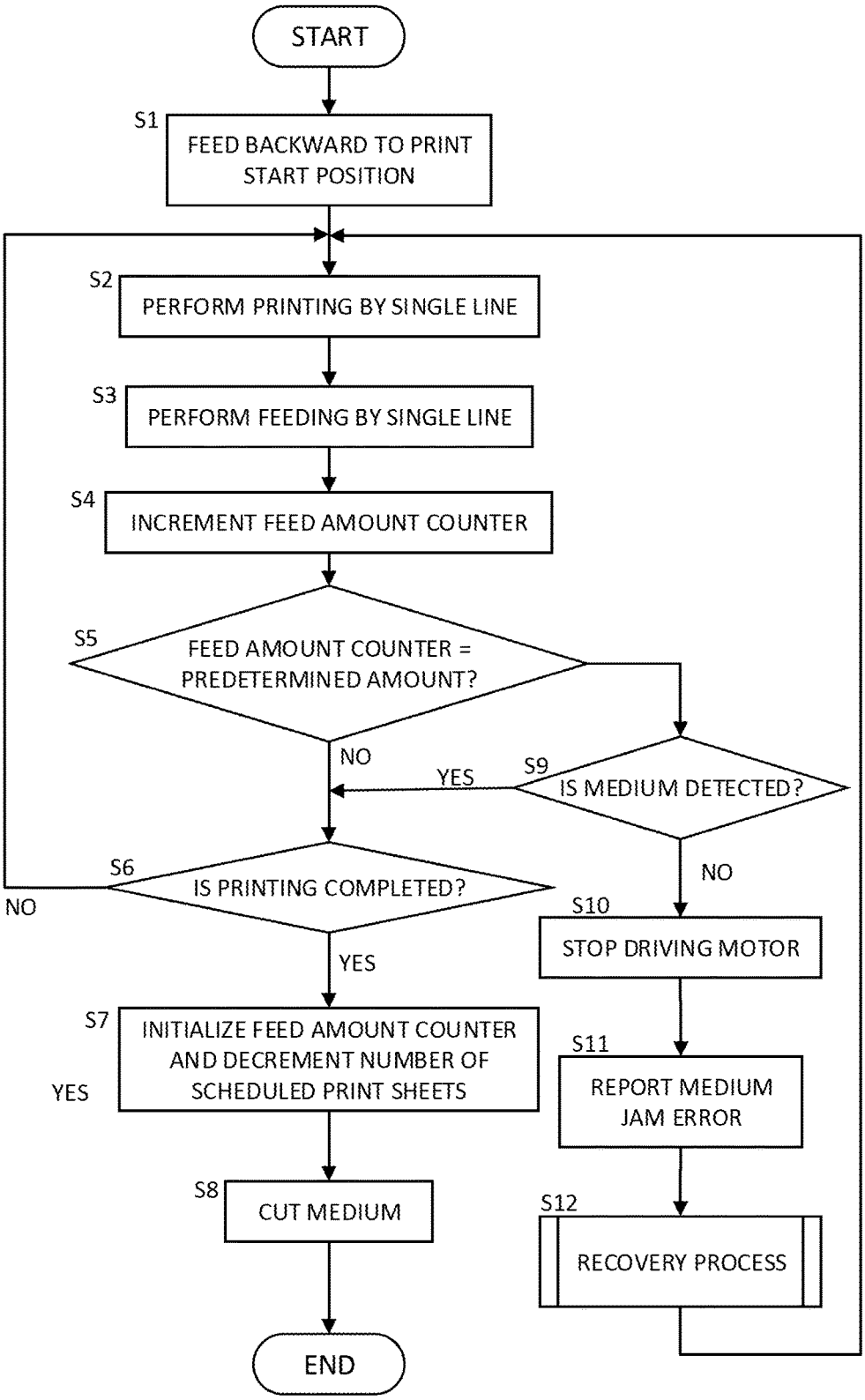
FIG. 5 is a flowchart illustrating operations of a print control program.

FIG. 5 illustrates operations of the print control program. This program is executed by the controller 5 when the controller 5 receives print data from an external computer (not shown). The operations of the print control will now be described in detail with reference to FIG. 5.

Specifically, in step S1, the controller 5 feeds the print medium M backward by reversely rotating the platen roller 12 to set the print medium M in the print start position.

In step S2, the controller 5 allows the electric current to flow to the heating element of the thermal head 11*h* depending on text or figures to be printed and performs printing on the print medium M by a single line.

In step S3, the controller 5 rotates the platen roller 12 forward by driving the platen roller driving motor 14 by a predetermined step in order to feed the print medium M by the amount corresponding to the single line printed in step S2. If the feed amount of the print medium M fed by driving the platen roller driving motor 14 by a single step matches a single line, the predetermined step is set to a single step.

In step S4, the controller 5 increments a feed amount counter by the number of steps driven by the platen roller driving motor 14 in step S2. An initial value of the feed amount counter is set to zero.

In step S5, the controller 5 determines whether or not the value of the feed amount counter reaches a predetermined value. The predetermined value is set to a value corresponding to a predetermined feed amount ($=Ls-Lx+\alpha$) by which a leading edge of the print medium M reaches the medium detection sensor 4 by driving the platen roller driving motor 14 by the number of steps from the print start position. If the determination result of step S5 is negative, the process advances to step S6.

In step S6, the controller 5 determines whether or not the printing of the received print data has been completed. If the determination result of step S6 is negative, the controller 5 returns the process to step S2 to perform printing for the next line and feed the print medium M. Otherwise, if the determination result of step S6 is affirmative, the controller 5 advances the process to step S7.

In step S6, whether or not the printing of the print data has been completed is determined even after the leading edge of the print medium M reaches the medium detection sensor 4. This is because, in some cases, a length of a single sheet of the print medium M is longer than the distance Ls between the medium detection sensor 4 and the thermal head 11*h*. In this case, it is necessary to return the process to step S2 and continuously perform printing even after the leading edge of the print medium M reaches the medium detection sensor 4.

In step S7, the controller 5 initializes the feed amount counter to zero and decrements the number of scheduled print sheets by one.

In step S8, the controller 5 feeds the print medium M such that a cutting location of the print medium M is positioned in the cutter 2. Then, the print medium M is cut using the cutter 2.

Otherwise, if the determination result of step S5 is affirmative, the process advances to step S9, so that the controller 5 determines whether or not the print medium M is detected by the medium detection sensor 4. If the print medium M is detected, it is determined that the print medium M reaches the medium detection sensor 4 without being wrapped around the platen roller 12. Therefore, the controller 5 determines that there is no wrapping-around of the print medium M and returns the process to step S6.

Otherwise, if the print medium M is not detected in step S9, the controller 5 determines that the print medium M is wrapped around the platen roller 12, and the process advances to step S10 to immediately stop the platen roller driving motor 14.

In step S11, the controller 5 reports a medium jam error to notify a user. The error may be notified using various methods such as a message or image displayed on a display unit of a thermal print apparatus 100 or an external computer, flickering of a lamp provided in the casing of the thermal print apparatus 100, or emission of voice or an alarm sound through a loud speaker of the thermal print apparatus 100 or the external computer.

In step S12, the controller 5 executes a recovery process for removing the print medium M wrapped around the platen roller 12.

Figure 6:
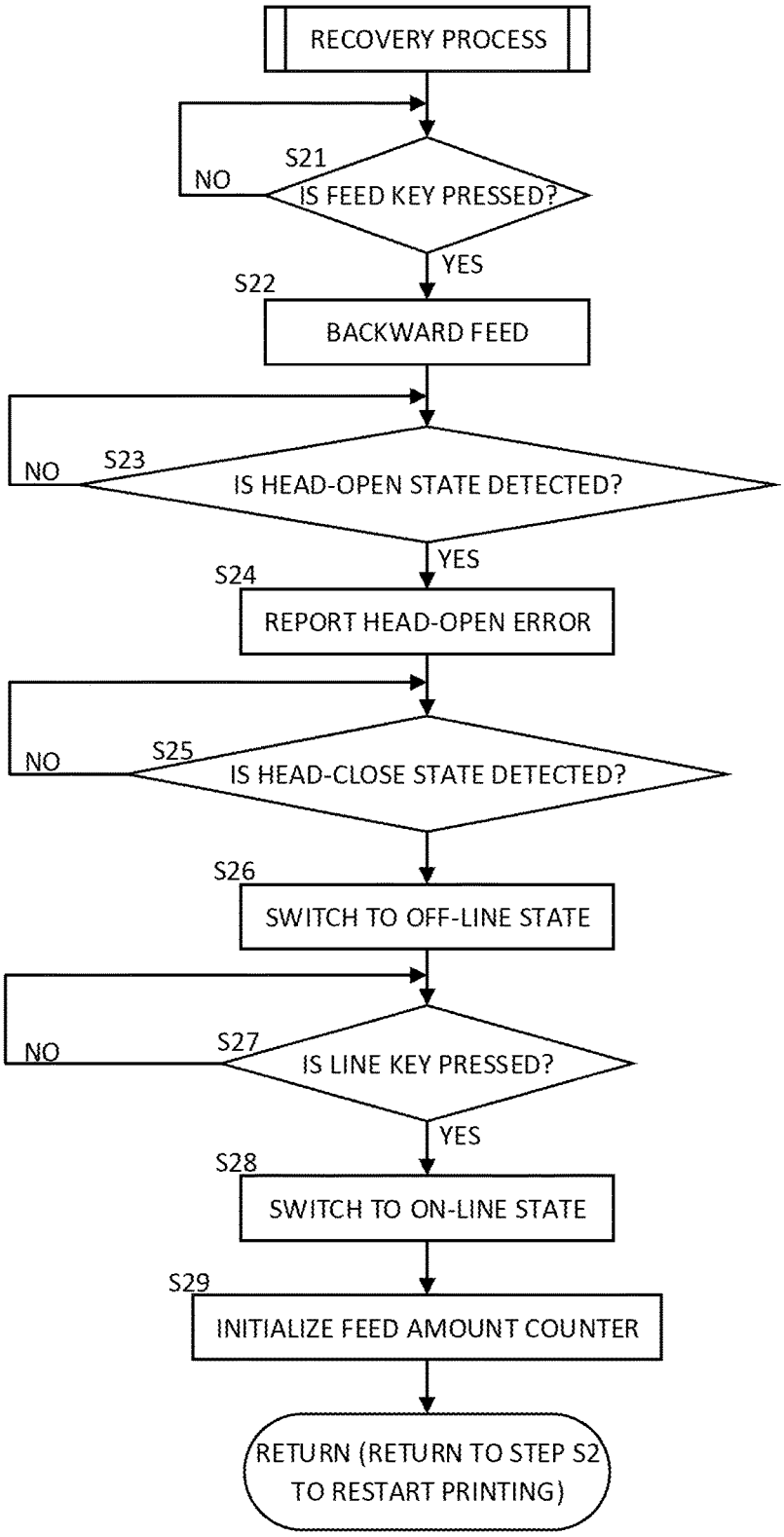
FIG. 6 is a flowchart illustrating a subroutine (recovery process) of the print control program.

FIG. 6 is a flowchart illustrating operations of the recovery process of step S12.

Specifically, in step S21, the controller 5 determines whether or not the FEED key 32 is pressed. The controller 5 repeats the determination of step S21 until it is determined that the FEED key 32 is pressed. If it is determined that the FEED key 32 is pressed, the process advances to step S22.

In step S22, the controller 5 does not execute forward rotation of the platen roller 12, which is a typical operation for a case where the FEED key 32 is pressed, but executes backward feeding of the print medium M by reversely rotating the platen roller 12. In this case, the backward feed amount is equal to a total feed amount of the print medium M by repeating step S3, that is, the feed amount of the print medium M from the print start position. As a result, the print medium M is stripped or removed from the platen roller 12.

The backward feed amount is set to be equal to the feed amount from the print start position in order to stop the print medium M while the print prohibition area passes over the thermal head 11*h*, that is, while the print medium M is sandwiched between the thermal head 11*h* and the platen roller 12. As a result, it is possible to prevent a leading edge of the print medium M from freely fluctuating and intruding or adhering to an unintended portion.

In step S23, the controller 5 determines whether or not a user moves the head unit 11 to an open position. The controller 5 repeats the determination of step S23 until it is determined that a user moves the head unit 11 to the open position. If it is determined that a user moves the head unit 11 to the open position, the process advances to step S24.

In step S24, the controller 5 reports a head open error to urge a user to reset the print medium M on the thermal print apparatus 100. The error may be reported using various methods similar to those of the medium jam error of step S11.

In step S25, the controller 5 determines whether or not a user moves the head unit 11 to a close position. The controller 5 repeats the determination of step S25 until it is determined that a user moves the head unit 11 to the close position. If it is determined that a user moves the head unit 11 to the close position, the process advances to step S26.

In step S26, the controller 5 switches the thermal print apparatus 100 to an off-line state.

In step S27, the controller 5 determines whether or not the LINE key 31 is pressed. The controller 5 repeats the determination of step S27 until it is determined that the LINE key 31 is pressed. If it is determined that the LINE key 31 is pressed, the process advances to step S28.

In step S28, the controller 5 switches the thermal print apparatus 100 to an on-line state.

In step S29, the controller 5 initializes the value of the feed amount counter. In addition, the controller 5 returns the process to step S2 and re-executes printing for the sheet suffering from the medium jam error.

Next, advantageous effects of the aforementioned configuration and advantageous effects obtained by executing the aforementioned print control will be described.

According to the embodiment described above, the medium detection sensor 4 is arranged from the thermal head 11*h* by the distance Ls shorter than the outer circumferential length Lp of the platen roller 12. In addition, if the print medium M is not detected by the medium detection sensor 4 even when the print medium M is fed by a feed amount at which the leading edge of the print medium M reaches the medium detection sensor 4 after starting of printing on the print medium M, it is determined that the print medium M is wrapped around the platen roller 12. In this case, the print medium M is fed backward by reversely rotating the platen roller 12.

According to this embodiment, it is determined that the print medium M is wrapped around the platen roller 12, and the print medium M is fed backward before the print medium M is wound around the entire circumference of the platen roller 12. Therefore, it is possible to smoothly strip or remove the print medium M from the platen roller 12. As a result, a work for removing the print medium M wrapped around the platen roller 12 by stretching user's fingers to the vicinity of the platen roller 12 is not necessary in most cases. Therefore, it is possible to facilitate a work for recovering a normal operation.

If it is determined that the print medium M is wrapped around the platen roller 12, a backward feed function is provided in the FEED key 32. In this case, the platen roller 12 is not rotated forward even when the FEED key 32 is pressed. That is, the forward rotation of the platen roller 12 is prohibited. When a medium jam occurs, a user tends to press a key relating to medium feeding. Therefore, according to this embodiment, if it is determined that the print medium M is trapped, the platen roller 12 is not rotated forward even when a user presses the FEED key. As a result, it is possible to prevent the print medium M from being more seriously wrapped around the platen roller 12 as the platen roller 12 is rotated forward. Therefore, it is possible to prevent a subsequent recovery work from being cumbersome.

As described above, when a medium jam occurs, a user tends to press a key relating to medium feeding. Therefore, a user who recognizes a medium jam error can press the FEED key 32 without confusion. As a result, it is possible to allow the thermal print apparatus 100 to perform an operation necessary to address wrapping-around of the print medium M (reverse rotation of the platen roller 12).

That is, a backward feed function is executed reversely to the original function of the FEED key 32 when wrapping-around of the print medium M occurs. Therefore, it is possible to prevent wrapping-around of the print medium M in the platen roller 12 from getting worse. In addition, advantageously, it is possible to allow a user to perform an operation for addressing wrapping-around of the print medium M without confusion.

In addition, the upstream-side guide 15 is placed between the print medium M and the platen roller 12. Therefore, when the platen roller 12 is rotated backward, the upstream-side guide 15 serves as a stripper for stripping the platen roller 12 from the print medium M. Therefore, it is possible to expedite removal of the print medium M from the platen roller 12.

Although embodiments of this invention have been described hereinbefore, the aforementioned embodiments are just a part of applications of this invention, and are not intended to limit the technical scope of this invention to specific configurations of the aforementioned embodiments.

For example, in the aforementioned embodiment, after it is determined that the print medium M is wrapped around the platen roller 12, the controller waits for pressing of the FEED key 32 to rotate the platen roller 12 backward. Alternatively, by deleting step S21 in FIG. 6, the platen roller 12 may be automatically rotated reversely to feed the print medium M backward without waiting for pressing of the FEED key 32 when it is determined that the print medium M is wrapped around the platen roller 12.

Alternatively, the platen roller 12 may be rotated reversely to feed the print medium M backward when any other key other than the FEED key 32 is pressed.

In the aforementioned embodiment, the forward rotation of the platen roller 12 is prohibited by allowing the FEED key 32 to have a function of reversely rotating the platen roller 12 when it is determined that the print medium M is wrapped around the platen roller 12. Alternatively, the forward rotation of the platen roller 12 may be prohibited regardless of a state of the FEED key 32 when it is determined that the print medium M is wrapped around the platen roller 12.

In the aforementioned embodiment, the controller 5 receives print data from an external computer and performs printing on the basis of the received print data. Alternatively, the print data may be created inside the controller 5, and the printing may be performed on the basis of the internal data (in a standalone type).

Wrapping-around of the print medium M in the platen roller 12 easily occurs when a linerless label is employed as the print medium M. In addition, when the wrapping-around occurs, a recovery work becomes cumbersome. In this regard, the aforementioned print control may be performed only when the linerless label is employed as the print medium M.

This application is based on and claims priority to Japanese Patent Application No. 2014-159326 filed in Japan Patent Office on Aug. 5, 2014, the entire content of which is incorporated herein by reference.

The invention claimed is:

1. A thermal print apparatus comprising:

a thermal head configured to perform printing on a print medium;

a platen roller configured to feed the print medium by sandwiching the print medium between the thermal head and the platen roller;

a medium detection sensor arranged from the thermal head at a distance shorter than an outer circumferential length of the platen roller, the medium detection sensor configured to detect the print medium after the print medium is fed by a feed amount at which a leading edge of the print medium reaches the medium detection sensor after starting of printing on the print medium;

a wrapping-around determination unit configured to determine whether the print medium is wrapped around the platen roller, wherein the wrapping-around determination unit determines that the print medium is not wrapped around the platen roller if the print medium is detected by the medium detection sensor after the print medium is fed by the feed amount, and the wrapping-around determination unit determines that the print medium is wrapped around the platen roller if the print medium is not detected by the medium detection sensor after the print medium is fed by the feed amount;

a particular key configured to feed the print medium by rotating the platen roller forward in response to the wrapping-around determination unit determining that the print medium is not wrapped around the platen roller, and the particular key is pressed; and a recovery processing unit configured to feed the print medium backward by reversely rotating the platen roller in response to the wrapping-around determination unit determining that the print medium is wrapped around the platen roller, and the particular key is pressed.

2. The thermal print apparatus according to claim 1, further comprising a guide member that is provided between the print medium and the platen roller in an upstream side from the thermal head and makes contact with the print medium, wherein the guide member is tangent to an outer circumference of the platen roller and configured to assist in stripping the print medium from the platen roller as the platen roller is reversely rotated.

3. A method of controlling a thermal print apparatus provided with a thermal head configured to perform printing on a print medium, a platen roller configured to feed the print medium by sandwiching the print medium between the thermal head and the platen roller, and a medium detection sensor separated from the thermal head at a distance shorter than an outer circumferential length of the platen roller, the medium detection sensor configured to detect the print medium after the print medium is fed by a feed amount at which a leading edge of the print medium reaches the medium detection sensor after starting of printing on the print medium, the method comprising:

determining whether the print medium is wrapped around the platen roller via a wrapping-around determination unit, the wrapping-around determination unit determining that the print medium is not wrapped around the platen roller if the print medium is detected by the medium detection sensor after the print medium is fed by the feed amount, and determining that the print medium is wrapped around the platen roller if the print medium is not detected by the medium detection sensor after the print medium is fed by the feed amount;

detecting that a particular key is pressed; and feeding the print medium by rotating the platen roller forward in response to a detection that the particular key is pressed and a determination that the print medium is not wrapped around the platen roller, or feeding the print medium backward by reversely rotating the platen roller in response to a detection that the particular key is pressed and a determination that the print medium is wrapped around the platen roller.

4. The thermal print apparatus according to claim 1, further comprising a guide member that is provided between the print medium and the platen roller in an upstream side from the thermal head and makes contact with the print medium, wherein a shaft of the platen roller is inserted into a bracket, and the guide member is connected to the bracket.

5. The thermal print apparatus according to claim 2, further comprising a second guide member that is provided between the print medium and the platen roller in a downstream side from the thermal head and makes contact with the print medium.

6. The thermal print apparatus according to claim 1, further comprising a guide member that is provided between the print medium and the platen roller in an upstream side from the thermal head, wherein the thermal head is configured to perform printing on an upper surface of the print medium, and the guide member makes contact with a lower surface of the print medium.

7. The thermal print apparatus according to claim 6, further comprising a second guide member that is provided between the print medium and the platen roller in a downstream side from the thermal head and makes contact with the lower surface of the print medium.

8. A thermal print apparatus comprising:

a thermal head configured to perform printing on a print medium;

a platen roller configured to feed the print medium by sandwiching the print medium between the thermal head and the platen roller;

a medium detection sensor arranged from the thermal head at a distance shorter than an outer circumferential length of the platen roller, the medium detection sensor configured to detect the print medium after the print medium is fed by a feed amount at which a leading edge of the print medium reaches the medium detection sensor after starting of printing on the print medium;

a feed key; and a controller programmed to:

determine whether the print medium is wrapped around the platen roller, wherein the controller determines that the print medium is not wrapped around the platen roller if the print medium is detected by the medium detection sensor after the print medium is fed by the feed amount, and the controller determines that the print medium is wrapped around the platen roller if the print medium is not detected by the medium detection sensor after the print medium is fed by the feed amount;

feed the print medium by rotating the platen roller forward in response to a determination that the print medium is not wrapped around the platen roller, and the feed key is pressed; and feed the print medium backward by reversely rotating the platen roller in response to a determination that the print medium is wrapped around the platen roller, and the feed key is pressed.

* * * * *